United States Patent [19]

Kim

[11] 4,382,166

[45] May 3, 1983

[54] JOYSTICK WITH BUILT-IN FIRE BUTTON

[75] Inventor: Syng N. Kim, Hoffman Estates, Ill.

[73] Assignee: Wico Corporation, Niles, Ill.

[21] Appl. No.: 327,261

[22] Filed: Dec. 3, 1981

[51] Int. Cl.[3] ..... H01H 19/00

[52] U.S. Cl. ..... 200/6 A; 200/18; 273/313; 273/DIG. 28

[58] Field of Search ..... 200/6 A, 6 B, 6 BA, 200/6 BB, 6 C, 18, 14, 1 A; 273/DIG. 28, 85 G, 313

[56] References Cited

U.S. PATENT DOCUMENTS

| | | | |
|---|---|---|---|
| 2,381,077 | 8/1945 | Obszarny | 200/1 A |
| 2,502,834 | 4/1950 | Dreyer | 35/25 |
| 2,531,608 | 11/1950 | Bula | 273/101.2 |
| 2,622,161 | 12/1952 | Harter, Jr. | 200/18 |
| 3,613,813 | 10/1971 | Biddle | 180/6.5 |
| 4,095,791 | 6/1978 | Smith et al. | 273/85 G |
| 4,142,180 | 2/1979 | Burson | 340/709 |
| 4,273,972 | 6/1981 | Butterworth | 200/6 A |

OTHER PUBLICATIONS

Wico Corporation Drawing No. 15-9531-01, Jun. 30, 1981.

*Primary Examiner*—A. T. Grimley
*Assistant Examiner*—Morris Ginsburg
*Attorney, Agent, or Firm*—Dithmar, Stotland, Stratman & Levy

[57] ABSTRACT

A joystick apparatus includes a tiltably mounted tube and a rod reciprocally movably axially therethrough. The tube has a frustoconical first actuator at one end thereof for operating engagement with a selected one or more of a plurality of first switches as the tube is tilted. The adjacent end of the rod carries a part-spherical second actuator for operating engagement with a second switch when the rod is extended from the tube, the shape of the second actuator keeping it in proper operating relationship with respect to the second switch regardless of the position of the tube.

10 Claims, 6 Drawing Figures

JOYSTICK WITH BUILT-IN FIRE BUTTON

The present invention relates to a joystick apparatus of the type which is used for controlling the operation of certain electronic games and the like. For example, the joystick assembly may be used to control the movement of a "blip" on the cathode ray tube ("CRT") screen of a video game.

Many types of video games involve the movement across the CRT screen of a pattern representing a vehicle such as a space craft, tank or the like which is provided with a weapon, the firing of which is simulated by the movement across the screen of a "blip" emanating from the vehicle pattern. Typically, there is one manually-operable vehicle control device for controlling the movement and orientation of the vehicle pattern and another manually-operable trigger device for firing the weapon. The direction in which the weapon will be fired is determined by the orientation of the vehicle pattern as controlled by the vehicle control device.

SUMMARY OF THE INVENTION

It is a general object of the present invention to provide an improved control apparatus which permits effective one-handed control of both the weapon firing and directional functions of a video game.

More specifically, it is an important object of this invention to provide a joystick apparatus for directional control with a built-in fire button or trigger which affords consistency of operation of the fire button regardless of the position of the joystick shaft.

It is another object of this invention to provide a joystick apparatus of the type set forth which is of simple and economical construction.

These and other objects of the invention are attained by providing a joystick apparatus for use with a device including a cathode ray tube in which blips are moved across the cathode ray tube screen and a first circuit to start the blip and a second circuit to control its direction, the joystick apparatus comprising a tube having an axis, a rod reciprocally movable in the tube axially thereof between a withdrawn position and an extended position, first actuator means associated with the rod, second actuator means attached to the tube, first switch means for connection to the first circuit and disposed for operation by the first actuator when the rod is disposed in the extended position thereof, a plurality of second switch means for connection to the second circuit and disposed around the second actuator, the tube being tiltably mounted to enable movement of the second actuator for operation of a selected one or more of the second switch means, the first actuator being constructed and arranged for cooperation with the rod to be in position to operate the first switch means in any tilting orientation of the tube.

The invention consists of certain novel features and a combination of parts hereinafter fully described, illustrated in the accompanying drawings, and particularly pointed out in the appended claims, it being understood that various changes in the details may be made without departing from the spirit or sacrificing any of the advantages of the invention.

DESCRIPTION OF THE PREFERRED EMBODIMENT

Figure 2:
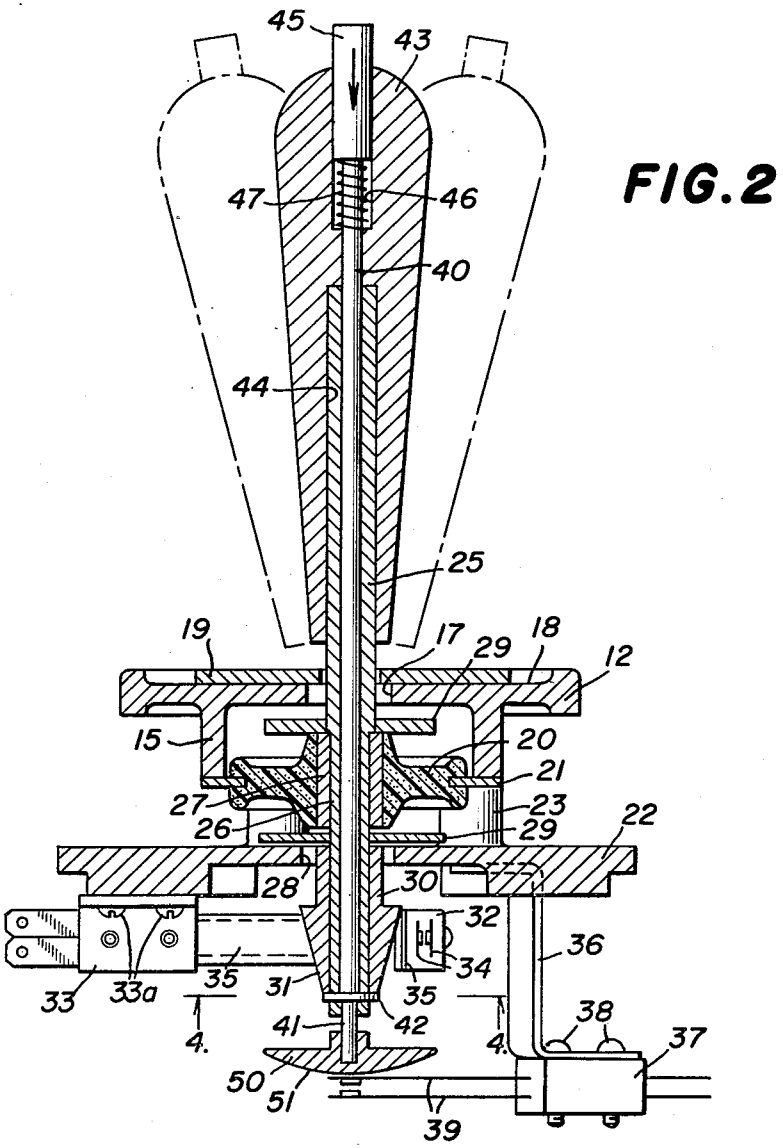
FIG. 2 is a view in vertical section taken along the line 2—2 in FIG. 1, and illustrating the tilting movement of the joystick shaft.
Figure 1:
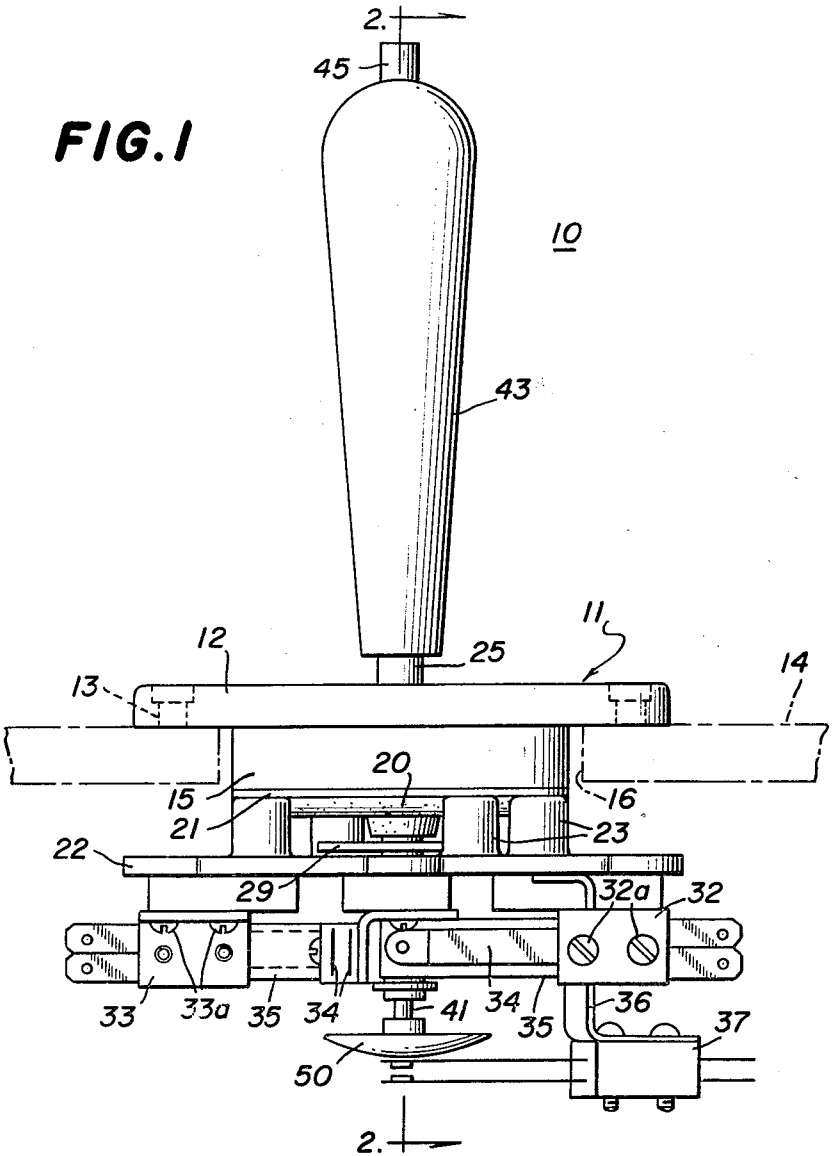
FIG. 1 is a side elevational view of a joystick apparatus constructed in accordance with and embodying the features of the present invention, with the joystick shaft illustrated in its neutral position.
Figure 3:
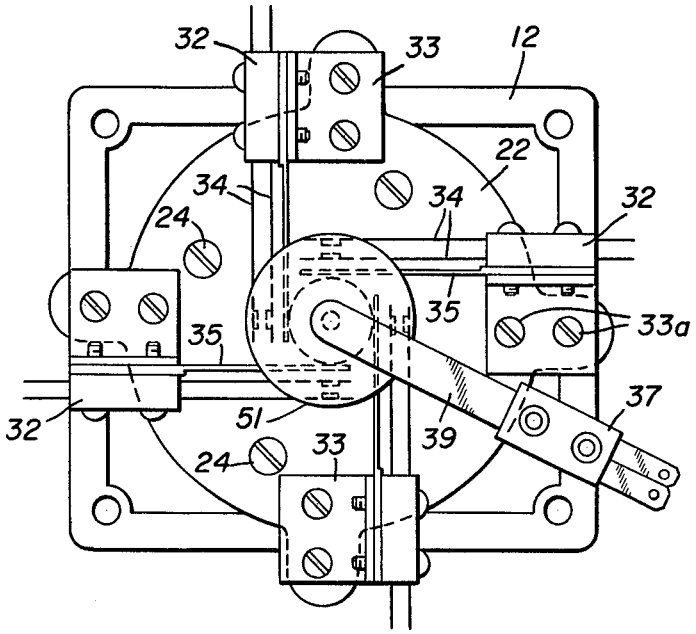
FIG. 3 is a bottom plan view of the joystick apparatus of FIG. 1.

Referring now to FIGS. 1 through 3 of the drawings, there is illustrated a joystick assembly, generally designated by the numeral 10, constructed in accordance with and embodying the features of the present invention. The joystick assembly 10 includes a frame 11 which is of unitary one-piece construction and is preferably formed of molded plastic. The frame 11 includes a generally flat rectangular support plate 12 which is adapted to be secured by suitable fasteners 13 to the outer surface of a support wall 14 of an associated device such as an electronic game. Integral with the support plate 12 and depending therefrom centrally thereof is a cylindrical housing 15 which is adapted, in use, to be disposed in a complementary opening 16 in the support wall 14, as indicated in FIG. 1. The support plate 12 has a circular opening 17 therethrough centrally thereof for a purpose to be explained below, and has formed in the outer surface thereof a recess 18 for accommodating a washer 19.

Disposed within the cylindrical housing 15 is a flexible pivot diaphragm 20 secured to an encompassing mounting plate 21 which is disposed in engagement with the inner end of the cylindrical housing 15 around the entire circumference thereof. The joystick assembly 10 also includes a switch mounting plate 22 having a plurality of spaced-apart bushings 23 which engage the inner surface of the diaphragm mounting plate 21 and receive therethrough associated fasteners 24 (see FIG. 3) for securely fastening together the frame 11, the pivot diaphragm 20 and the switch mounting plate 22.

The joystick assembly 10 also includes an elongated cylindrical shaft 25 in the form of a hollow tube which extends through the washer 19 and the opening 17 in the support plate 12 and has a reduced diameter portion 26 surrounded by a bearing sleeve 27 and fixedly secured in a complementary opening centrally of the flexible pivot diaphragm 20. Washers 29 encircle the shaft 25 immediately above and below the diaphragm 20. The shaft 25 extends inwardly through the complementary opening 28 in the switch mounting plate 22 and is provided at the inner end thereof with an actuator sleeve 30 fixedly secured thereto. The actuator sleeve 30 has a frustoconical outer surface 31 disposed for operating engagement with a plurality of switches 32, which are preferably of the molded type. Four such switches 32 are provided in the preferred embodiment, but it will be appreciated that other numbers of switches could be provided for different types of control, as will be explained more fully below. Each of the switches 32 is secured by fasteners 32a to a bracket 33 which is in turn secured by fasteners 33a to the switch mounting plate 22. Each of the switches 32 is provided with a pair of leaf contacts 34 and a guard actuator 35.

Figure 4:
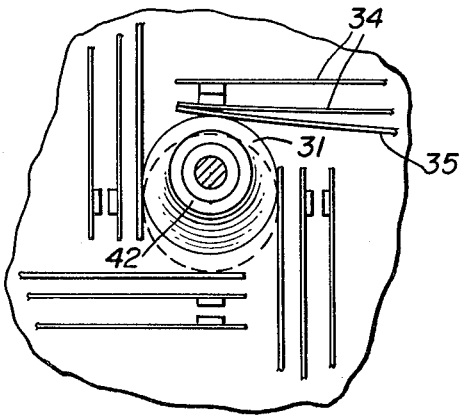
FIG. 4 is a fragmentary view taken along the line 4—4 in FIG. 2 and illustrating movement of the joystick shaft to operate a single switch.
Figure 5:
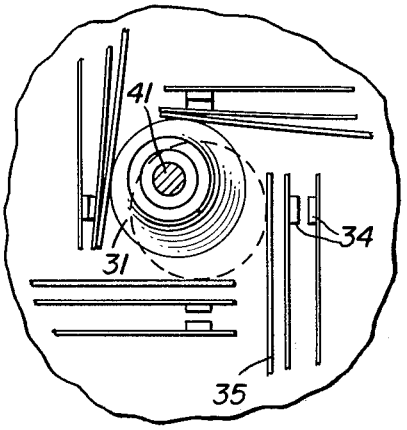
FIG. 5 is a view similar to FIG. 4, and illustrating movement of the joystick shaft to operate two switches simultaneously.
Figure 6:
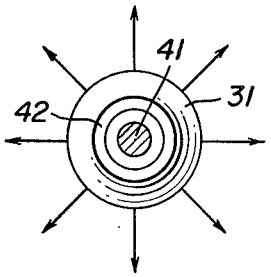
FIG. 6 is a view of the joystick shaft similar to that in FIG. 4, and illustrating the range of tilting movement of the shaft.

In operation, the flexible pivot diaphragm 20 accommodates a pivotal movement of the shaft 25 about an infinite number of axes passing through the center of the pivot diaphragm 20, a number of these axes being illustrated by the arrows in FIG. 6. The extent of tilting movement along any axis is limited by the diameter of the opening 17 in the support plate 12, the opening 17 being dimensioned to permit the shaft 25 to pivot far enough in each direction to bring the actuator surface 31 into engagement with the guard actuators 35 and deflect them sufficiently to close the associated switch contacts 34. Referring to FIGS. 4 and 5, it will be seen that if the shaft 25 is pivoted in any of the horizontal or vertical directions indicated by the arrows in FIG. 6, only one of the switches 32 will be operated (see FIG. 4), whereas if the shaft 25 is pivoted in one of the diagonal directions, the actuator sleeve 30 will simultaneously close the contacts of two adjacent ones of the switches 32 (see FIG. 5). Thus, there is provided an eight-way control. However, it will be appreciated that the number of possible control variations can be increased by increasing the number of switches 32.

It is a significant aspect of the invention that the shape of the frustoconical surface 31 is such that when the shaft 25 is tilted sufficiently to cause actuation of one or more of the switches 32, the frustoconical surface 31 will be disposed substantially parallel to the surface of the engaged guard actuator 35 to maximize the contact area and assure a firm positive closure of the switch contacts 34.

Also carried by the switch mounting plate 22 is a mounting bracket 36 on which is mounted a molded switch 37 by means of fasteners 38. The switch 37 has leaf contacts 39 which project radially inwardly toward the shaft 25 to a position spaced a predetermined distance from the inner end of the shaft 25 along the axis thereof when the shaft 25 is disposed in its neutral position, illustrated in solid lines in FIGS. 1 and 2. Slidably disposed within the tubular shaft 25 for reciprocating movement axially thereof is an elongated rod 40, which has an outer end projecting well beyond the outer end of the shaft 25 and a reduced-diameter inner end 41 projecting beyond the inner end of the shaft 25. Secured to the inner end 41 of the rod 40 is a retainer 42, which may be in the form of an "E" clip, to limit the withdrawal or retraction of the rod 40 into the shaft 25.

Fixedly secured to the outer end of the shaft 25 in surrounding relationship therewith is an elongated handle 43 having an axial bore 44 therethrough in which is received the shaft 25 and the rod 40. A cylindrical plunger button 45 is disposed in an outer portion 46 of the bore 44 and is fixedly secured, as by threaded engagement, to the outer end of the rod 40. A helical compression spring 47 is disposed in surrounding relationship with the rod 40 between the inner end of the plunger button 45 and the inner end of the bore portion 46 for resiliently urging the plunger button 45 and the rod 40 outwardly to a normal withdrawn position, illustrated in FIG. 2. It will be appreciated that the rod 40 is movable axially inwardly against the urging of the bias spring 47 to an extended position by depression of the plunger button 45 in the direction of the arrow in FIG. 2.

Fixedly secured to the inner end 41 of the rod 40 is an actuator 50 having a part-spherical surface 51 disposed for engagement with the contacts 39 of the switch 37. More specifically, when the rod 40 is disposed in its withdrawn position, the surface 51 of the actuator 50 is disposed just out of engagement with the switch contacts 39 for maintaining the switch 37 open, and, when the rod 40 is moved to its extended position by depression of the plunger button 45, the surface is moved into operating engagement with the switch contacts 39 for closure thereof. It is a significant aspect of the invention that the radius and extent of the part-spherical surface 51 are such that depression of the plunger button 45 will effect closure of the switch contacts 39 regardless of the tilted position of the shaft 25, thereby providing consistent positive operation of the switch 37.

Preferably, the switches 32 are connected to an associated circuit for controlling the direction of movement and orientation of a vehicle pattern on the associated CRT screen, and, thereby, controlling the direction of movement of the weapon "blip". The switch 37 is connected to another circuit for controlling the firing of the weapon, i.e., controlling the start of the emission of the "blip" from the weapon on the CRT screen. It can be seen that the joystick assembly 10 affords a simple one-hand control of both of these functions, the handle 43 being gripped by the fingers of a user, and the plunger button 45 being actuated by the thumb.

In a constructional model of the present invention, the pivot diaphragm 20 is preferably formed of a soft flexible plastic material, while the actuators 30 and 50 and the guard actuators 35 are formed of a harder plastic material. The handle 43 and the shaft 25 may also be formed of plastic and may be molded in a unitary one-piece construction.

From the foregoing, it can be seen that there has been provided an improved joystick assembly which affords one-hand control of both the firing initiation and direction of a weapon "blip" in a video game, the assembly assuring consistent positive operation of associated switches regardless of the position of the joystick.

I claim:

1. Joystick apparatus comprising a tube having an axis, a rod reciprocally movable in said tube axially thereof between a withdrawn position and an extended position, first actuator means mounted on said rod, second actuator means attached to said tube, first switch means disposed for operation by said first actuator means when said rod is disposed in the extended position thereof, a plurality of second switch means disposed around said second actuator means, and mounting means disposed intermediate the ends of said tube and defining a fulcrum point thereat and supporting said tube for tilting movement about said fulcrum point to effect movement of said second actuator means for operation of a selected one or more of said second switch means, said first actuator means being constructed and arranged for cooperation with said rod to be in position to operate said first switch means in any tilting orientation of said tube.

2. The joystick apparatus of claim 1, and further comprising a handle encompassing at least a portion of said tube.

3. The joystick apparatus of claim 2, wherein one end of said rod is recessed within said handle, and further comprising a plunger reciprocally carried by said handle and having a thumb engagement surface at one end thereof and a rod engagement surface at the other end thereof engaging said one end of said rod.

4. The joystick apparatus of claim 2, and further comprising means carried by said handle for biasing said rod to the withdrawn position thereof.

5. The joystick apparatus of claim 1, wherein one end of said rod projects from one end of said tube adjacent to said first switch means, said second actuator means being disposed adjacent to said one end of said tube.

6. The joystick apparatus of claim 1, wherein said first actuator means is disposed between said rod and said first switch means.

7. The joystick apparatus of claim 6, wherein said first actuator means includes a part-spherical engagement surface.

8. The joystick apparatus of claim 5, wherein said first actuator means is attached to said one end of said rod.

9. The joystick apparatus of claim 8, wherein said first actuator means has a part-spherical engagement surface disposed for operating engagement with said first switch means.

10. The joystick apparatus of claim 5, wherein said second actuator means is disposed between said one end of said tube and said fulcrum point.

* * * * *